US006045338A

United States Patent [19]

Morita

[11] Patent Number: 6,045,338

[45] Date of Patent: Apr. 4, 2000

[54] COMPOUND GEAR PUMPS AND ENGINE HYDRAULIC CIRCUITS USING SAME

[75] Inventor: Shoji Morita, Kanagawa, Japan

[73] Assignee: Unisia Jecs Corporation, Atsugi, Japan

[21] Appl. No.: 09/023,216

[22] Filed: Feb. 13, 1998

[30] Foreign Application Priority Data

Mar. 27, 1997 [JP] Japan ..... 9-076119

[51] Int. Cl.[7] ..... F01C 1/30

[52] U.S. Cl. ..... 417/252; 417/310; 418/3; 123/90.17

[58] Field of Search ..... 418/3, 9, 10; 417/251, 417/252, 253, 310; 123/90.17, 90.31

[56] References Cited

U.S. PATENT DOCUMENTS

| | | | |
|---|---|---|---|
| 3,238,738 | 3/1966 | Webber et al. | 417/253 |
| 4,597,726 | 7/1986 | Soderlund et al. | 418/201.2 |
| 5,586,875 | 12/1996 | Ondrejko et al. | 418/3 |
| 5,669,343 | 9/1997 | Adachi | 123/90.17 |

FOREIGN PATENT DOCUMENTS

| | | | |
|---|---|---|---|
| 0253133 | 1/1988 | European Pat. Off. . | |
| 20 49 452 | 5/1971 | Germany . | |
| 34 45 454 | 6/1986 | Germany . | |
| 50-114705 U | 2/1949 | Japan . | |
| 306754 | 6/1971 | Russian Federation | 418/3 |
| 1234889 | 6/1971 | United Kingdom | 418/3 |
| 2017218 | 10/1979 | United Kingdom . | |

*Primary Examiner*—Charles G. Freay
*Attorney, Agent, or Firm*—Foley & Lardner

[57] ABSTRACT

A compound gear pump includes an internal gear pump including an outer rotor having on the outer periphery external teeth, an external gear pump including a rotor having on the outer periphery an external teeth circumscribed with the external teeth of the outer rotor, and a guide face arranged on the outer periphery of the outer rotor and being adjacent to the external teeth of the outer rotor in the axial direction thereof.

6 Claims, 3 Drawing Sheets

COMPOUND GEAR PUMPS AND ENGINE HYDRAULIC CIRCUITS USING SAME

BACKGROUND OF THE INVENTION

The present invention relates to compound gear pumps and engine hydraulic circuits using same.

One of the compound gear pumps is disclosed in JP-U 50-114705. This pump is of the external gear type including a crescent-type internal gear pump so called having a crescent between inner and outer rotors wherein the difference in number of teeth therebetween is two or more, and a third rotor having external teeth circumscribed with external teeth of the outer rotor.

Specifically, the outer rotor having 31 internal teeth eccentrically disposed to and inscribed with the inner rotor having 24 external teeth is rotatably arranged in a circular large-diameter concavity formed in a casing. The outer rotor has also 31 external teeth arranged axially on the whole outer periphery, which are meshed with the 12 external teeth of the third rotor rotatably arranged in a circular small-diameter concavity continuously formed with the large-diameter concavity. The outer rotor is rotatably held in the large-diameter concavity through slide contact of the top of its external teeth with a wall of the large-diameter concavity.

With the known compound gear pump, however, since rotatable holding of the outer rotor is ensured by slide contact of the top of its external teeth with the wall of the large-diameter concavity, the pressure on a contact face of the top of the external teeth may be increased to produce wear of the inner periphery of the casing and the top of the external gear, resulting in, at worst, seizing of the two.

Moreover, since the difference in number of teeth is great between the inner rotor having 24 external teeth and the outer rotor having 31 internal teeth, the outer rotor is quite lower in number of revolutions than the inner rotor, having substantially ⅔ the number of revolutions of the inner rotor. This causes lowered number of revolutions of the third rotor driven by the outer rotor. Thus, in order to secure a predetermined discharge of an external gear pump, the external teeth of the outer rotor meshed with those of the third rotor should be increased in width or height. Such increase in width or height of the external teeth is accompanied with a reduction in thickness of the outer rotor. In view of the fact that the compound gear pump has the same numbers of the inner and outer teeth on the inner and outer peripheries of the outer rotor, the strength of the outer rotor should be secured by avoiding the inner and outer teeth radially overlapping each other as described in the above reference. As a consequence, the degree of freedom is decreased with regard to a design of the external teeth of the outer rotor, causing a problem of difficult determination of the optimum specification of the external gear pump.

It is, therefore, an object of the present invention to provide compound gear pumps which are free from wear and seizing, and allow easy determination of their optimum specifications.

Another object of the present invention is to provide engine hydraulic circuits using the compound gear pumps.

SUMMARY OF THE INVENTION

According to one aspect of the present invention, there is provided a gear pump device, comprising:

a casing with an inner wall;

a first pump including inner and outer rotors, said inner rotor having on an outer periphery external teeth, said outer rotor having on an inner periphery internal teeth and on an outer periphery external teeth;

a second pump including a rotor, said rotor having on an outer periphery an external teeth circumscribed with said external teeth of said outer rotor; and a guide face arranged on said outer periphery of said outer rotor, said guide face being adjacent to said external teeth of said outer rotor in an axial direction thereof.

Another aspect of the present invention lies in providing a hydraulic circuit for an engine with a crankshaft, comprising:

a gear pump device including:

a casing with an inner wall;

a first pump driven by the crankshaft, said first pump including inner and outer rotors, said inner rotor having on an outer periphery external teeth, said outer rotor having on an inner periphery internal teeth and on an outer periphery external teeth;

a second pump including a rotor, said rotor having on an outer periphery an external teeth circumscribed with said external teeth of said outer rotor; and a guide face arranged on said outer periphery of said outer rotor, said guide face being adjacent to said external teeth of said outer rotor in an axial direction thereof;

a main gallery connected to the engine, said main gallery being arranged between a discharge passage of said first pump and a suction passage of said second pump;

a first relief valve arranged between suction and discharge passages of said first pump, said first relief valve having a first set pressure;

a valve controller connected to a discharge passage of said second pump; and a second relief valve arranged between suction and discharge passages of said second pump, said second relief valve having a second set pressure.

DETAILED DESCRIPTION OF THE INVENTION

Figure 1:
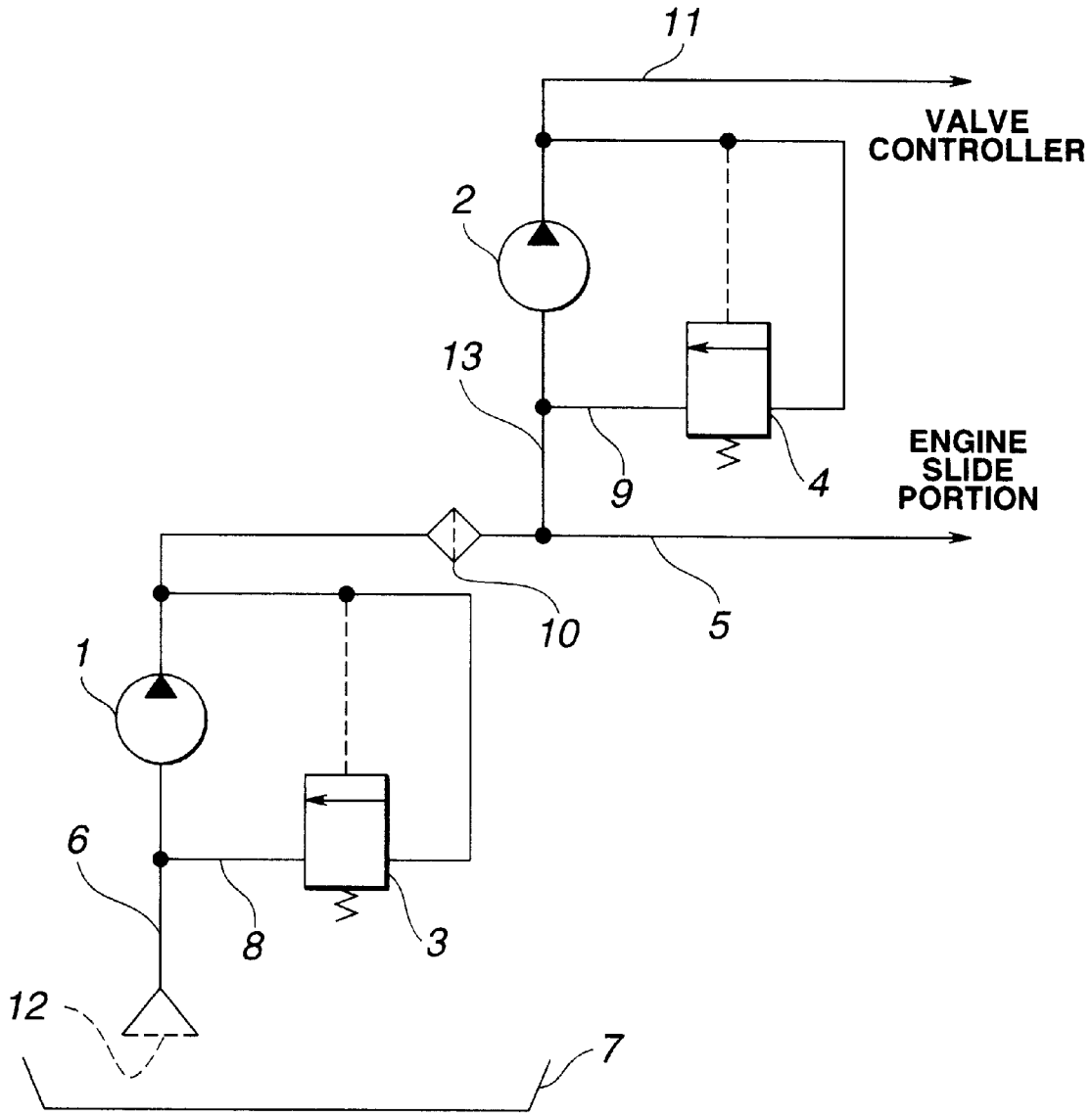
FIG. 1 is a diagram showing a hydraulic circuit embodying the present invention.

Referring to FIG. 1, a hydraulic circuit includes a first gear pump 1 as will be described in detail later and driven by a crankshaft 21 (see FIG. 2). The first pump 1 sucks oil within an oil pan 7 through an oil strainer 12 and a suction passage 6, and discharges it to a main gallery 5. A first relief valve 3 having a first set pressure is arranged to communicate with the main gallery 5 for supplying oil to engine sliding portions which require lubrication. A relief passage 8 of the first relief valve 3 communicates with the suction passage 6.

The hydraulic circuit also includes a second gear pump 2 as will be described in detail later and driven by an outer rotor of the first gear pump 1. A suction passage 13 of the second gear pump 2 communicates with the main gallery 5 downstream of an oil filter 10. A discharge passage 11 of the second gear pump 2 is connected to a valve controller as will be described later. A second relief valve 4 having a second set pressure is arranged to communicate with the discharge passage 11 for supplying working oil to the valve controller. A relief passage 9 of the second relief valve 4 communicates with the suction passage 6. The first set pressure of the first relief valve 3 is lower than the second relief pressure of the second relief valve 4.

Figure 2:
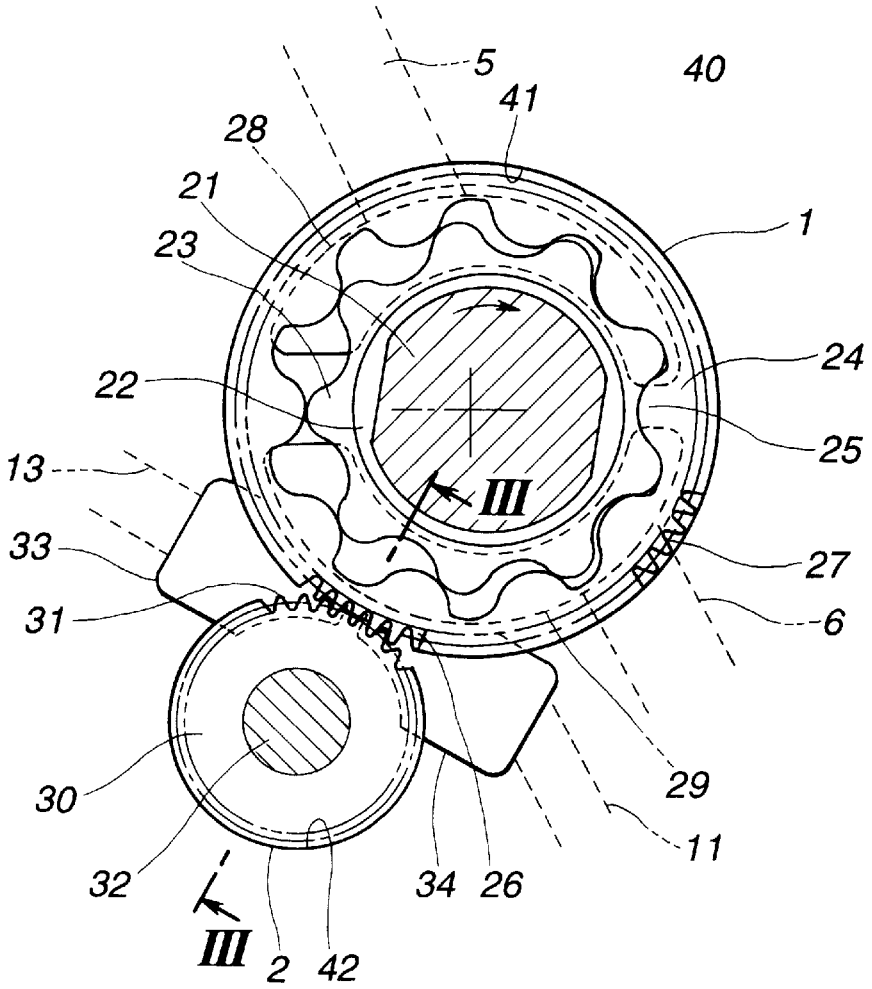
FIG. 2 is a sectional view showing a compound gear pump used in the hydraulic circuit.
Figure 3:
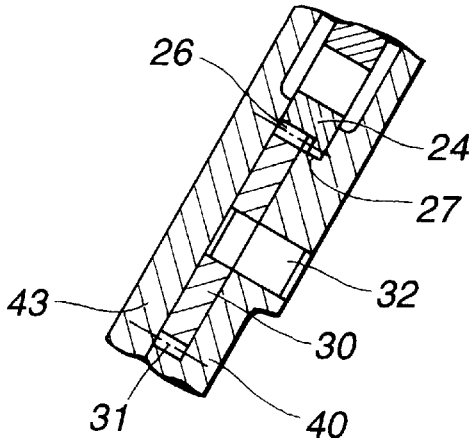
FIG. 3 is a view similar to FIG. 2, taken along the line III—III.

Referring to FIGS. 2–3, the first and second gear pumps 1, 2 constitute a compound gear pump.

Specifically, the first gear pump 1 connected to and driven by the crankshaft 21 includes an inner rotor 22 having a predetermined number (9 in the embodiment) of external teeth 23, and an outer rotor 24 having internal teeth 25 larger in number than the external teeth 23 by one, the outer rotor 24 being rotatably accommodated in a circular large-diameter concavity 41 of a casing 40, forming an internal gear pump. The casing 40 is formed with a first suction port 29 communicating with the suction passage 6, and a first discharge port 28 communicating with the main gallery 5.

The second gear pump 2 includes a third rotor 30 having on the outer periphery external teeth 31 meshed with external teeth 26 of the outer rotor 24 of the first gear pump 1, which are axially partly formed on the outer periphery, the third rotor 30 being rotatably accommodated in a circular small-diameter concavity 42 of the casing 40 through a shaft 32 fixed thereto, forming an external gear pump. The casing 40 is also formed with a second suction port 33 communicating with the suction passage 13, and a second discharge port 34 communicating with the discharge passage 11.

Referring to FIG. 3, arranged on the outer periphery of the outer rotor 24 is a guide face 27 which is axially adjacent to the external teeth 26 of the outer rotor 24, and is in slide contact with an inner wall of the large-diameter concavity 41 of the casing 40. The diameter of the guide face 27 is slightly larger than that of the external teeth 26.

A pump cover 43 is joined to the casing 40 having the large-diameter concavity 41 accommodating the inner and outer rotors 22, 24, and the small-diameter concavity 42 accommodating the third rotor 30, thus defining a pump chamber.

Figure 4:
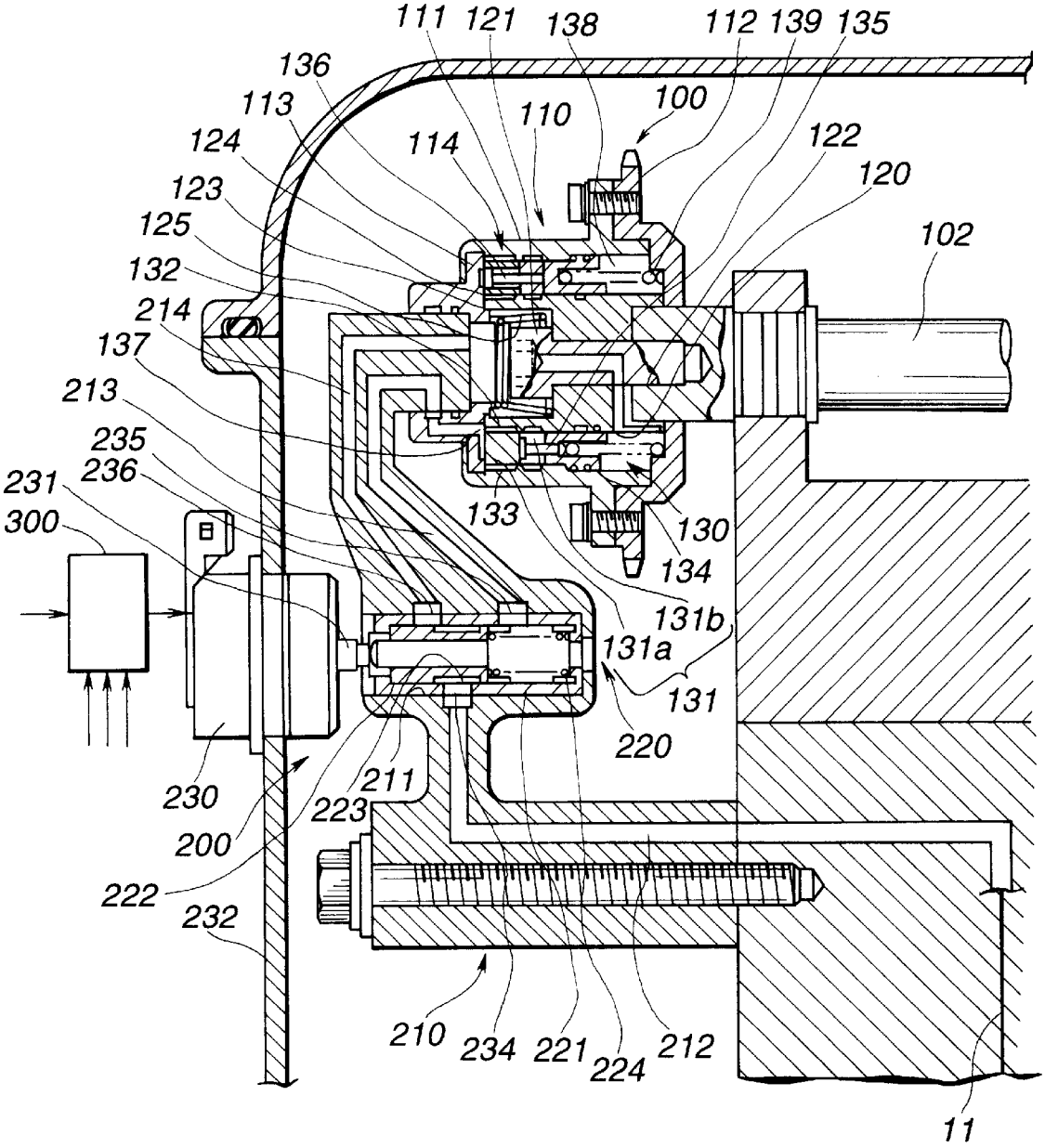
FIG. 4 is a view similar to FIG. 3, showing a valve opening/closing timing controller to which the present invention is applied.

Referring next to FIG. 4, a valve opening/closing timing controller as an example of the valve controller will be described. The valve opening/closing timing controller comprises a rotation-phase alteration part 100 and a hydraulic-pressure control part 200.

The rotation-phase alteration part 100 is disposed at one end of a camshaft 102 to transmit torque of a crankshaft, not shown, and alter a rotation phase of the camshaft 102. Engaged with the camshaft 102 is a suction and/or exhaust valve, not shown, which carries opening/closing operation in accordance with rotation of the camshaft 102.

Specifically, the rotation-phase alteration part 100 comprises a sprocket 110 relatively rotatably disposed with respect to the camshaft 102, an end member 120 fixed to an end of the camshaft 102 by a bolt 121, and a movable member 130 arranged in a space between the sprocket 110 and the end member 120.

The sprocket 110 includes a cylindrical main body 111, a tooth forming member 112 fixed to the main body 111 by a bolt and having on the outer periphery sprocket teeth which are meshed with a timing chain driven by the crankshaft, and a cover 113 fixed to the main body 111 through caulking. The main body 111 has a helical spline 114 on part of the inner peripheral surface near the cover 113.

The end member 120 is shaped like substantially a stepped cylinder, and has in the center a through hole 122 for the bolt 121 and an annular recess 123 for accommodating the head of the bolt 121. Moreover, the end member 120 has a helical spline 124 on part of the outer peripheral surface near the cover 113. A coil spring 125 is arranged to prevent collisional contact of the cover 113 of the sprocket 110 with the end member 120.

The movable member 130 includes a ring 131 having on the inner and outer peripheral surfaces helical splines 132, 133 meshed with the helical splines 124, 114 of the end member 120 and the main body 111, respectively, and a ring-like piston 134 connected to the ring 131 by a pin 135 to axially drive it. In order to prevent backlash between the spline meshed portions, the ring 131 includes two axially divided portions, i.e. first and second ring members 131*a*, 131*b*, which are resiliently interconnected by a pin 136. A hydraulic actuator is constructed by a hydraulic chamber 137 hermetically defined between the front of the ring-like piston 134 and the cover 113, and a second hydraulic chamber 138 hermetically defined between the rear of the ring-like piston 134 and the tooth forming member 112. A coil spring 139 having a relatively large spring constant is disposed in the second hydraulic chamber 138 to press/maintain the ring-like piston 134 and thus the ring 131 to/in the initial position, i.e. the left end as viewed in FIG. 4.

The hydraulic-pressure control part 200 comprises a spool valve 220 for switching an oil passage as will be described later and formed through an oil-passage member 210 mounted to an engine block, and a proportional-solenoid type electromagnetic actuator 230 for driving the spool valve 220.

The spool valve 220 includes a cylindrical valve body 221 arranged in a hole 211 of the oil-passage member 210, and a spool 222 slidably arranged therein to switch a passage. The spool 222 is biased to the initial position, i.e. the left end as viewed in FIG. 4, by a spring 224. Moreover, the spool 222 is driven against a biasing force of the spring 224 by an operation rod 231 of the electromagnetic actuator 230 fixed to a rocker cover 232.

The oil-passage member 210 and the valve body 22 are formed with oil supply ports 234, first oil supply/discharge ports 235, and second oil supply/discharge ports 236, respectively, to correspond to each other. The oil supply ports 234 communicate with the discharge passage 11 through an oil supply passage 212, and the first oil supply/discharge ports 235 communicate with the first hydraulic chamber 137 through a first oil supply/discharge passage 213 (including a passage formed through the cover 113), and the second oil supply/discharge ports 236 communicate with the second hydraulic chamber 138 through a second oil supply/discharge passage 214 (including passages formed through the bolt 121 and the end member 120). The spool 222, which is formed with an annular groove 223, controls the relative positional relationship between the oil supply ports 234, the first oil supply/discharge ports 235, and the second oil supply/discharge ports 236 to variably control the opening areas of the first oil supply/discharge ports 235 and the second oil supply/discharge ports 236, thus obtaining controlled hydraulic pressures within the first and second hydraulic chambers 137, 138.

The spool valve 220 has both ends opened to allow oil drainage. Drained oil is fallen in the oil pan 7.

The electromagnetic actuator 230 is controlled by a controller 300 to have varied amount of advancement of the operation rod 231. In accordance with signals derived from various sensors such as crank angle sensor, air flowmeter, coolant-temperature sensor, and throttle-valve switch, not shown, the controller 300 determines an actual engine operating condition to provide a control signal.

In the embodiment, with engine start, the inner rotor 22 of the first gear pump 1 is driven in synchronism with the crankshaft 21. The outer rotor 24 meshed therewith is driven with substantially the same number of revolutions as that of the inner rotor 22 since the difference in number of teeth between the inner and outer rotors 22, 24 is one. By means of a volume variation of a space due to the difference in number of teeth, the first gear pump 1 sucks oil within the oil pan 7 through the suction passage 6 and the first suction port 29, and discharge it to the main gallery 5 through the first discharge port 28. When rotation of the crankshaft 21, i.e. the engine speed, is increased, and the hydraulic pressure within the main gallery 5 is greater than the first set pressure of the first relief valve 3, the first relief valve 3 is opened to relieve surplus oil through the relief passage 8, maintaining the hydraulic pressure within the main gallery 5 at a predetermined value.

On the other hand, the second gear pump 2 is driven, together with the third rotor 30, by the outer rotor 24 driven with substantially the same number of revolutions as that of the inner rotor 22. The second gear pump 2 sucks oil from the main gallery 5 downstream of the oil filter 10 through the suction passage 13 and the second suction port 33, and discharge it to the discharge passage 11 connected to the valve opening/closing timing controller through the second discharge port 34. When the hydraulic pressure within the discharge passage 11 is greater than the second set pressure of the second relief valve 4, the second relief valve 4 is opened to relieve surplus oil through the relief passage 9, maintaining the hydraulic pressure within the discharge passage 11 at a predetermined value.

At that time, in keeping in slide contact with the inner wall of the large-diameter concavity 41 of the casing 40, the outer rotor 24 is rotated through the guide face 27 formed on the outer periphery thereof, whereas the third rotor 30 is rotated in guiding the shaft 32 fixed to the casing 40. Therefore, the external teeth 26 of the outer rotor 24 do not need to contact the inner wall of the large-diameter concavity 41, having remarkably reduced wear.

When alteration of the opening/closing timing of the suction and/or exhaust valve is not needed, the operation rod 231 of the electromagnetic actuator 230 and the spool 222 are in their initial positions as shown in FIG. 4 to ensure communication of the oil supply port 234 with the second oil supply/discharge port 238 through the annular groove 223. The ring-like piston 134 and the ring 131 are also in their initial positions as shown in FIG. 4 by biasing the coil spring 139 to ensure communication of the second hydraulic chamber 138 having its maximum volume with the discharge passage 11. At that time, the second hydraulic chamber 138 of the hydraulic actuator forms a closed circuit, so that surplus oil within the discharge passage 11 is relieved through the relief passage 9, maintaining the hydraulic pressure within the discharge passage 11 at a predetermined relief set value.

When altering the opening/closing timing of the suction and/or exhaust valve, the controller 300 provides a signal to the electromagnetic valve 230 to protrude the operation rod 231 by a predetermined amount, moving the spool 222 from the initial position as shown in FIG. 4 to the right. By way of example, when maximally varying the phase of the camshaft 102 with respect to the sprocket 110, the spool 222 is moved to the rightmost end in the permissible range. This puts the oil supply port 234 in communication with the first oil supply/discharge port 235 through the annular groove 223, and opens the second oil supply/discharge port 236. Then, oil is supplied from the discharge passage 11 to the first hydraulic chamber 137 through the first oil supply/discharge passage 213, whereas oil within the second hydraulic chamber 138 is drained through the second oil supply/discharge passage 214, moving rightward the ring-like piston 134 and thus the ring 131 against a biasing force of the spring 139. At that time, the first hydraulic chamber 138 of the hydraulic actuator forms a closed circuit, so that the ring 131 is maintained to ensure the maximum volume of the first hydraulic chamber 138, wherein a force acting on the ring-like piston 134 and resulting from the predetermined relief set pressure within the discharge passage 11 balances with a biasing force of the spring 139.

With movement of the ring 131, the meshed positions of the helical splines 124, 114 of the end member 120 and the main body 111 meshed with the helical splines 132, 133 of the ring 131 are axially displaced to alter the phase of the camshaft 102 with respect to the sprocket 110. This results in maximum alteration of the opening/closing timing of the suction and/or exhaust valve.

When altering the opening/closing timing of the suction and/or discharge valve in the medium way, the spool 222 is moved to a predetermined position. This puts the oil supply port 234 in partial communication with the first oil supply/discharge port 235 through the annular groove 223, and allows partial oil drainage. On the other hand, the amount of advancement of the operation rod 231 of the electromagnetic actuator 230 is controlled to partly open the second oil supply/discharge port 236. Then, oil within the discharge passage 11 is drained partly and adjusted in pressure, which is supplied to the first hydraulic chamber 137 through the first oil supply/discharge passage 213, whereas oil within the second hydraulic chamber 138 is partly drained through the second oil supply/discharge passage 214, maintaining the ring-like piston 134 and thus the ring 131 in a position displaced rightward by a predetermined amount against a biasing force of the spring 139.

The hydraulic actuator of the valve opening/closing timing controller, which forms substantially a closed circuit, produces a volume variation only during movement of the ring-like piston 134, so that during non-movement thereof, the hydraulic pressure within the discharge passage 11 is immediately increased regardless of the number of revolutions of the crankshaft 21 and as long as the engine rotates, and is maintained at a predetermined value based on the set pressure of the second relief valve 4. Note that due to its instantaneous movement, the ring-like piston 134 of the hydraulic actuator is in non-movement during the greater part of engine operation. At that time, surplus oil is sucked in the second gear pump 2 again, or is returned to the main gallery 5 through the relief passage 9.

During non-movement of the ring-like piston 134 of the hydraulic actuator, oil with flow quantity Q2 is wholly returned to the main gallery 5, producing no pressure reduction in the main gallery 5. Thus, the first gear pump 1 only needs to have a discharge corresponding to the flow quantity Q1 necessary for lubrication of the engine sliding portions.

Moreover, during movement of the ring-like piston 134 of the hydraulic actuator, there is no oil returned from the discharge passage 11, producing temporary lowering of the hydraulic pressure within the main gallery 5. However, as described above, the hydraulic actuator forms substantially a closed circuit and is very short in movement time, so that the hydraulic pressure within the main galley 5 is recovered instantaneously, having no bad influence on the engine sliding portions.

In such a way, according to the embodiment, even with the structure using combination of the first and second gear pumps 1, 2, communication of the relief passage 9 of the second gear pump 2 with the main gallery 5 allows the first gear pump 1 to have a discharge equal to or smaller than the flow quantity Q1 necessary for lubrication of the engine sliding portions, avoiding enlargement of the first gear pump 1. This results in no increase in power consumption and fuel expenses.

Moreover, according to the embodiment, the second set pressure of the second relief valve 4 is lower than the first set pressure of the first relief valve 3. When the engine rotates at low speed, e.g. 2,000 rpm or less, the discharge pressure of the first gear pump 1 is low, so that the second gear pump 2 pressurizes oil which is supplied to the valve opening/closing timing controller for operation thereof. With an increase in engine speed, the discharge pressure of the first gear pump 1 is increased to reach the first set pressure of the first relief valve 3. On the other hand, the discharge passage 11 of the second gear pump 2, which is connected to form substantially a closed circuit as described above, has the second set pressure of the second relief passage 4 regardless of the engine speed. However, since the second set pressure of the second relief valve 4 is lower than the first set pressure of the first relief valve 3, the second gear pump 2 does not need to carry out pressurization at the engine speed greater than a value which enables the hydraulic pressure greater than the second set pressure of the second relief valve 4. The reason is that in view of the fact that the work volume of a pump is generally defined by "flow quantity×pressure", the hydraulic pressure almost close to zero means that the work volume is nearly zero.

Therefore, the second gear pump 2 needs to do work only in the range of lowest engine speed wherein the first gear pump 1 cannot produce a predetermined discharge pressure, and practically no work in the range of higher engine speed than that, resulting in possible reduction in power consumption of the second gear pump 2.

Having described the present invention with regard to the preferred embodiment, it is noted that the present invention is not limited thereto, and various changes and modifications can be made without departing from the scope of the present invention. By way of example, in the embodiment, the valve controller is in the form of a valve opening/closing timing controller, alternatively, it is in the form of a valve-lift amount switching controller.

What is claimed is:

1. A gear pump device, comprising:

a casing with an inner wall;

a first pump including inner and outer rotors, said inner rotor having on an outer periphery external teeth, said outer rotor having on an inner periphery internal teeth and on an outer periphery external teeth;

a second pump including a rotor, said rotor having on an outer periphery external teeth circumscribed with said external teeth of said outer rotor; and a guide face arranged on said outer periphery of said outer rotor, said guide face being adjacent to said external teeth of said outer rotor in an axial direction thereof, said guide face being in slide contact with said inner wall of said casing.

2. A gear pump device as claimed in claim 1, wherein said guide face is slightly larger in outer diameter than said external teeth of said outer rotor.

3. A gear pump device as claimed in claim 1, wherein a difference in number of teeth between said external teeth of said inner rotor and said internal teeth of said outer rotor is one.

4. A gear pump device as claimed in claim 1, wherein said guide face is formed as a lip on a top surface of said outer rotor of said first pump, said lip extending along an entire 360 degree circumference of the outer periphery of said outer rotor of said first pump.

5. A hydraulic circuit for an engine with a crankshaft, comprising:

a gear pump device including:

a casing with an inner wall;

a first pump driven by the crankshaft, said first pump including inner and outer rotors, said inner rotor having on an outer periphery external teeth, said outer rotor having on an inner periphery internal teeth and on an outer periphery external teeth;

a second pump including a rotor, said rotor having on an outer periphery external teeth circumscribed with said external teeth of said outer rotor; and a guide face arranged on said outer periphery of said outer rotor, said guide face being adjacent to said external teeth of said outer rotor in an axial direction thereof;

a main gallery connected to the engine, said main gallery being arranged between a discharge passage of said first pump and a suction passage of said second pump;

a first relief valve arranged between suction and discharge passages of said first pump, said first relief valve having a first set pressure;

a valve controller connected to a discharge passage of said second pump; and a second relief valve arranged between suction and discharge passages of said second pump, said second relief valve having a second set pressure.

6. A hydraulic circuit as claimed in claim 5, wherein said second set pressure of said second relief valve is lower than said first set pressure of said first relief valve.

* * * * *